US006698057B2

(12) United States Patent
Varga

(10) Patent No.: US 6,698,057 B2
(45) Date of Patent: Mar. 2, 2004

(54) SCRUB BRUSH WITH INTEGRAL HANDLE

(75) Inventor: George Varga, Jupiter, FL (US)

(73) Assignee: MPS Products, Inc., Jupiter, FL (US)

( * ) Notice: Subject to any disclaimer, the term of this patent is extended or adjusted under 35 U.S.C. 154(b) by 404 days.

(21) Appl. No.: 09/827,622

(22) Filed: Apr. 5, 2001

(65) Prior Publication Data

US 2002/0144370 A1 Oct. 10, 2002

(51) Int. Cl.[7] ..... A46B 5/00
(52) U.S. Cl. ..... 15/145; 15/159.1; 15/176.1
(58) Field of Search ..... 15/114, 143.1, 15/144.1, 144.2, 144.3, 145, 171, 159.1, 176.1, 176.6

(56) References Cited

U.S. PATENT DOCUMENTS 1,821,875 A * 9/1931 Bochnek ..... 403/181
4,285,096 A * 8/1981 Swaim ..... 16/422
4,329,755 A * 5/1982 Alissandratos ..... 15/144.4
5,323,506 A * 6/1994 Babitch ..... 15/210.1
5,515,574 A * 5/1996 Larson ..... 16/429
5,878,459 A * 3/1999 McParland ..... 15/114
5,890,254 A * 4/1999 Courtney et al. ..... 15/145
6,105,194 A * 8/2000 Rudolph ..... 15/145
6,438,784 B1 * 8/2002 Yu ..... 15/106

* cited by examiner

*Primary Examiner*—Terrence R. Till
(74) *Attorney, Agent, or Firm*—McHale & Slavin, P.A.

(57) ABSTRACT

A cleaning/scrub brush has an adapter integrally molded into the body of the brush. The distal end of the adapter is totally enclosed within the plastic body of the brush and has a structure to increase the surface area of the adapter within the brush to strengthen the molded bond. The proximal end of the adapter has a spring loaded pin to secure an elongated handle to the brush.

14 Claims, 1 Drawing Sheet

SCRUB BRUSH WITH INTEGRAL HANDLE

FIELD OF THE INVENTION

The invention is directed to an improved cleaning/scrub brush which incorporates an adapter integrally formed into a plastic/poly block during the molding process.

1. Background of the Invention

Conventional scrub brushes have a handle that is mechanically secured to the brush component. The usual connection is by cooperating screw threads in the brush and on one end of the handle. The brushes and handles are made of wood and protected by a varnish or paint coating. Alternatively, the scrub brushes have a handle that is inserted into the brush component and held in place by a fastener placed perpendicular to the handle.

Also, in brushes made of other materials, the connection may be threaded or made by telescoped elements having friction detents and spring loaded pins. Such a connection may be made by drilling a recess in the brush to accept the connection components and the outside diameter of the handle.

In normal usage the connection is in prolonged contact with strong chemicals, repeatedly submerged in fresh or salt water, and subjected to heavy torsional, compressing and flexing forces. When the protective coating of a wood brush begins to break down, the wood becomes soaked and deteriorates. Even with brushes made of materials other than wood, the drilled connection becomes unstable. The connection between the handle and brush becomes worn and cannot be relied on to hold the brush and handle together rendering the brush useless.

What is lacking in the prior art is a cleaning/scrub brush which has an adapter integrally formed in the brush to absorb the torsional, compressing and bending forces and displace the connection between the brush and the handle away from the area of harshest environment. The extra length of the adapter allows a greater degree of overlap between the adapter and the handle increasing stability of the connection.

2. Description of the Prior Art

The prior art is replete with examples of mops, scrub brushes and other cleaning implements. U.S. Pat. No. 4,285,096, issued Aug. 25, 1981, illustrates the screw handle and brush combination. The patent teaches the brush component having both the male or female screw threads, as alternatives.

U.S. Pat. No. 4,329,755 discloses a molded brush head with a threaded connection to a handle. U.S. Pat. No. 5,323,506 discloses a brush with a molded connection between the brush and the handle. U.S. Pat. No. 5,515,574 discloses a telescoping handle with spring loaded pins fitting into detents for securing the elements together. The handle is non-cylindrical to withstand twisting forces on the pins.

SUMMARY OF THE INVENTION

A cleaning/scrub brush having a body with bristles extending therefrom and an adapter. The bristles and the adapter are integrally connected by a molded bond, the body formed of a solid block of polymer having a substantial thickness with the bristles extending from the bottom of the body to a periphery thereof. The adapter extends from the top of the body with a distal end of the adapted enclosed within the substantial thickness of the body to increase the surface area of the distal end and the bond.

Accordingly, it is an objective of this invention to provide a new cleaning/scrub brush made of a molded polymer block integrally formed with artificial bristles and an adapter molded into the brush.

Another objective of the invention is to provide the distal end of the adapter with structure increasing the surface area between the brush and the distal end of the adapter.

A further objective of the invention is to provide the distal end of the adapter with structure to resist torsional forces during use of the brush.

Still another objective of the invention is to eliminate the need for through-holes wherein the distal end of a handle protrudes through brush support.

It is another objective of the invention to provide a telescoped joint between the adapter and an extended handle with a locking device having cooperating elements on the adapter and handle to temporarily secure the adapter and handle together during use.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

The cleaning/scrub brush 10 has a polymer body 11 made of any plastic capable of being molded into a hard block of substantial thickness, such as polyethylene, polypropylene, polystyrene, nylon and the like.

Figure 2:
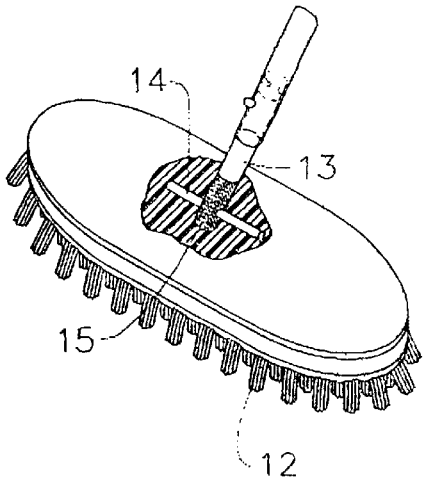
FIG. 2 is a partial cut-away of the brush and the distal end of the adapter.

Synthetic bristles 12 can be molded into the body 11 but are commonly staple set by machine. As shown, the bristles 12 extend from the bottom of the body in two rows as a result of bundles of bristles being folded upon themselves and incorporated into the body, as shown in FIG. 2. The thickness of the body is such that the distal end of the adapter extends below the fold of the bristles. The bristles may be of any long wearing polymer designed for the intended application, preferably of a polymer that is not affected by temperatures of the molding process.

Figure 1:
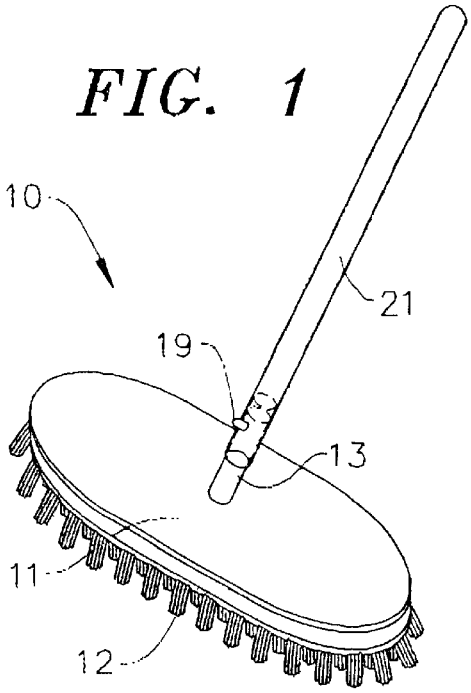
FIG. 1 illustrates a perspective of the brush and adapter connected to an extended handle.

The adapter 13 is preferably made of tubular stainless steel because of the caustic environment that such brushes are commonly used, but other metals may also be employed. The adapter may also be a solid rod or sized to accept a threaded "ACME" tip. In the case of a threaded tip, the adapter would again be part of the block and would extend upward like the preferred embodiment but would be threaded to receive a tip from a handle. Also certain plastics, with the requisite structural properties of strength and temperature tolerance, may be used for the adapter. As shown in FIGS. 1 and 2, the proximal end of adapter 13 exits the top of the body 11 of the brush at an acute angle to provides vectored force to the bristles during use. The angular orientation also contributes to the strength of the connection between the adapter and the body.

The distal end of the adapter is totally enclosed within the body 11 and includes structure to increase the stability of the molded connection between the adapter and the body. In FIG. 2, a pin 14 extends transversely through the distal end of the adapter 13. The pin may be affixed to the adapter by welding or as a bolt extending through a transverse bore. As shown, the pin 14 is normal to the adapter but other angular dispositions are contemplated. For example, the ends of the pin may be oriented at angles less than 90 degrees to the axis of the adapter. Knurling 15 is used to further increase the surface area of the adapter and increase the bonding strength between the body and the adapter. The knurling or other roughening of the adapter may be included on all the embodiments of the adapter.

Figure 3:
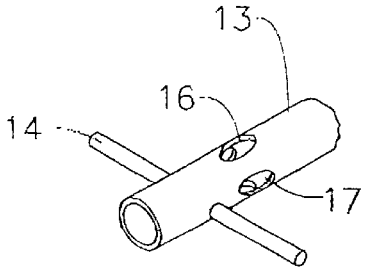
FIG. 3 illustrates another embodiment of the distal end of the adapter.

The tubular adapter 13 may be provided with apertures 16 and 17, shown in FIG. 3, to permit the polymer to invade the cavity of the adapter during the molding process. This doubles the bonding surface between the components, as well as, creating a more continuous bond. There may be more than two apertures in the adapter with the pin 14 extending through opposite apertures. The pin 14 may be omitted from this embodiment.

Figure 4:
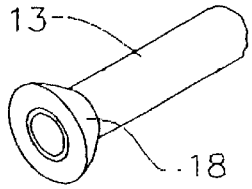
FIG. 4 is illustrates another embodiment of the distal end of the adapter.

A flange 18 may be formed on the distal end of the adapter 13 at any location within the bonded area to increase the surface area, as shown in FIG. 4. Multiple flanges may also be used.

Figure 5:
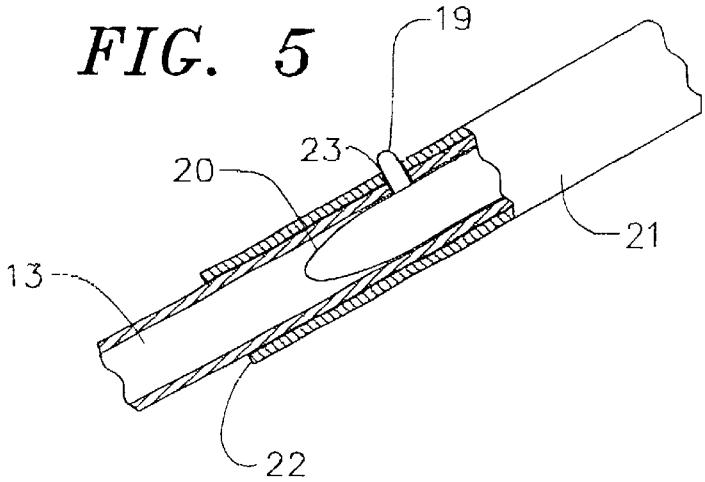
FIG. 5 is a partial cross section of the joint between the adapter and the handle.

In FIG. 5 the preferred telescoped joint between the adapter and an elongated handle is illustrated. Obviously, the telescoped elements may be reversed. The mating surfaces of the adapter and handle may be cylindrical or non-cylindrical. In this embodiment, the adapter 13 carries a reciprocating pin 19 held in the extended position by a spring 20. The spring 20 is illustrated as a leaf spring but may be a coil spring, if desired. The elongated handle 21 has an axial bore 22 with an internal diameter closely approximating the outside diameter of the adapter 13. The handle has a hole or detent 23 to accept the pin 19 to secure the connection between the adapter and handle. Attachment may also be made by use of double springs wherein buttons protrude on opposite sides of the tubing, or by use a threaded tip as previously mentioned.

As shown, the proximal end of the adapter 13 rests against the end wall of the axial bore 22 in the handle. Such a construction would accommodate the compression forces present during use of the brush. In the event that the handle is tubular, a pin or internal constriction may be present to cooperate with the proximal end of the adapter.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to the specification and drawings.

What is claimed is:

1. A cleaning/scrub brush comprising a body with bristles extending therefrom and an adapter, said body, said bristles and said adapter integrally connected by a molded bond, said body formed of a solid block of polymer having a substantial thickness, a bottom, a top and a periphery, said bristles extending from said bottom of said body about said periphery thereof, said adapter extending from said top of said body, said adapter having a distal end enclosed within said substantial thickness of said body, said distal end including structure to increase the surface area of said distal end and said bond.

2. A cleaning/scrub brush of claim 1 further comprising said structure to increase the surface area of said distal end and said bond including a transverse pin extending through said distal end.

3. A cleaning/scrub brush of claim 2 further comprising said adapter having a proximal end and at least one spring loaded pin mounted in said proximal end for securing a handle.

4. A cleaning/scrub brush of claim 1 further comprising said structure to increase the surface area of said distal end and said bond including a roughened portion of said distal end.

5. A cleaning/scrub brush of claim 4 further comprising said adapter having a proximal end and a spring loaded pin mounted in said proximal end for securing a handle.

6. A cleaning/scrub brush of claim 1 further comprising said adapter being tubular, said structure to increase the surface area of said distal end and said bond including a plurality of apertures in said distal end, a portion of said body extending through said apertures.

7. A cleaning/scrub brush of claim 6 further comprising said adapter being metal.

8. A cleaning/scrub brush of claim 6 further comprising a pin extending through some of said plurality of apertures.

9. A cleaning/scrub brush of claim 7 further comprising said adapter having a proximal end and a spring loaded pin mounted in said proximal end for securing a handle.

10. A cleaning/scrub brush of claim 1 further comprising said structure to increase the surface area of said distal end and said bond including a flange about said distal end.

11. A cleaning/scrub brush of claim 10 further comprising said adapter having a proximal end and a spring loaded pin mounted in said proximal end for securing a handle.

12. A cleaning/scrub brush of claim 1 further comprising said adapter made of a metal tube.

13. A cleaning/scrub brush of claim 12 further comprising said adapter being stainless steel.

14. A cleaning/scrub brush of claim 7 further comprising said metal being stainless steel.

* * * * *